US010532877B2

(12) United States Patent
Price et al.

(10) Patent No.: US 10,532,877 B2
(45) Date of Patent: Jan. 14, 2020

(54) INTERLOCKING INSULATED VESSEL

(71) Applicant: Footbottles, LLC, Menlo Park, CA (US)

(72) Inventors: Travis Elliot Price, Menlo Park, CA (US); Joshua Lampert, Atherton, CA (US)

(73) Assignee: Footbottles, LLC, Menlo Park, CA (US)

( * ) Notice: Subject to any disclaimer, the term of this patent is extended or adjusted under 35 U.S.C. 154(b) by 171 days.

(21) Appl. No.: 15/793,930

(22) Filed: Oct. 25, 2017

(65) Prior Publication Data

US 2019/0119030 A1 Apr. 25, 2019

(51) Int. Cl.

*B65D 81/00* (2006.01)
*B65D 81/38* (2006.01)
*B65D 21/02* (2006.01)

(52) U.S. Cl.

CPC ..... *B65D 81/3827* (2013.01); *B65D 21/0228* (2013.01); *B65D 21/0233* (2013.01); *B65D 81/3837* (2013.01)

(58) Field of Classification Search

CPC ..... B65D 81/3827; B65D 81/3879; B65D 21/0233; B65D 21/0228
USPC ..... 215/10
See application file for complete search history.

(56) References Cited

U.S. PATENT DOCUMENTS 1,672,877 A 6/1928 Bowman
3,624,939 A 12/1971 Gossard et al.
D228,328 S 9/1973 Schley et al.
3,873,003 A * 3/1975 Seiferth ..... B65D 83/0027 222/105
4,164,284 A 8/1979 Witt et al.
4,207,990 A * 6/1980 Weiler ..... A61J 1/1406 215/375
D266,436 S 10/1982 Smith
4,456,134 A * 6/1984 Cooper ..... B65D 1/0292 215/12.1
D275,922 S 10/1984 Weil
D298,105 S 10/1988 Lamantia, Jr.
4,823,974 A * 4/1989 Crosser ..... A47G 19/2288 206/545
D319,008 S 8/1991 Leon
D323,602 S 2/1992 Katz
D340,078 S 10/1993 Turner
5,269,428 A * 12/1993 Gilbert ..... B65D 1/0292 215/376
D351,656 S 10/1994 Collins
(Continued)

*Primary Examiner* — Ernesto A Grano
(74) *Attorney, Agent, or Firm* — Fenwick & West LLP

(57) ABSTRACT

An interlocking vessel includes a cylindrical container secured inside an insulated receiving component by reciprocal screw threads. The cylindrical container has a first screw thread with a plurality of turns for engagement with a cap and a second screw thread with a plurality of turns along the exterior of the body extending downward from a top portion of the body to the bottom of the cylindrical container. The insulated receiving component has a reciprocal screw thread along the interior of the body for engagement with the cylindrical container. In one embodiment, turning the cylindrical container in a downward clockwise motion engages the reciprocal screw threads, thus securing the cylindrical container in the insulated receiving component.

20 Claims, 4 Drawing Sheets

(56) References Cited

U.S. PATENT DOCUMENTS 5,450,979 A 9/1995 Servick et al.
D369,544 S 5/1996 Culliss
D370,154 S 5/1996 Gruneisen, III
D374,678 S 10/1996 Yang et al.
5,662,241 A * 9/1997 Sorensen ..... B65D 23/001 220/630
D391,155 S 2/1998 Edson et al.
D392,512 S 3/1998 Bennett et al.
D392,844 S * 3/1998 Todorya ..... D7/606
D411,715 S 6/1999 Hansen
RE36,377 E * 11/1999 Gilbert ..... B65D 23/00 215/382
6,041,918 A 3/2000 Moore
D424,375 S 5/2000 D'Arrigo
D424,876 S 5/2000 McPartland
D425,757 S 5/2000 Printz et al.
D447,422 S * 9/2001 Peek ..... D9/552
6,484,897 B1 * 11/2002 Crawley ..... B65D 11/04 215/307
D470,401 S * 2/2003 Genoa ..... D9/503
6,554,155 B1 * 4/2003 Beggins ..... B65D 81/3879 220/592.16
D477,132 S 7/2003 Bond et al.
RE38,770 E * 8/2005 Gilbert ..... B65D 1/0292 215/382
D511,212 S 11/2005 Whalen
D518,596 S 4/2006 Angeletta
D541,111 S 4/2007 Morgan et al.
7,201,285 B2 * 4/2007 Beggins ..... B65D 81/3879 215/386
D575,079 S 8/2008 Hirsh
D580,775 S 11/2008 Harris
D587,968 S 3/2009 Campbell
D589,765 S * 4/2009 Zuloff ..... D7/515
D590,134 S 4/2009 Rogondino
D604,086 S 11/2009 Lipinski et al.
D608,590 S 1/2010 Geter et al.
D609,111 S 2/2010 Bentley et al.
D614,504 S 4/2010 Coat
D621,657 S 8/2010 Quinn
D623,905 S 9/2010 Paslawski
D624,368 S 9/2010 Paslawski
D627,233 S 11/2010 Blakeman
D629,306 S 12/2010 Staton et al.
D633,342 S 3/2011 Paslawski
7,992,714 B1 * 8/2011 Devault ..... A47G 19/10 108/26
D666,919 S 9/2012 Gelin
D673,428 S 1/2013 Lessells
8,365,963 B2 * 2/2013 McCullough ..... A47K 5/12 222/153.01
D686,884 S 7/2013 Carter
D710,152 S 8/2014 Marini
D710,154 S 8/2014 Marini
D711,690 S 8/2014 Sutton et al.
D716,104 S 10/2014 Lessells
D718,146 S 11/2014 Tussy
D724,902 S 3/2015 Dickerson et al.
D735,050 S 7/2015 Tussy
D737,540 S 8/2015 Borella
9,408,779 B2 8/2016 Stewart
D775,913 S 1/2017 Knirr
D789,748 S 6/2017 Peters et al.
D790,282 S 6/2017 Price et al.
D802,188 S 11/2017 Chan
9,845,989 B1 * 12/2017 Veiga ..... F25D 31/007
D821,886 S 7/2018 Paulin et al.
2005/0194345 A1 * 9/2005 Beggins ..... B65D 81/3879 215/386
2005/0230405 A1 * 10/2005 Dix ..... B65D 81/3879 220/737
2006/0227537 A1 10/2006 Vanderschuit
2011/0009218 A1 * 1/2011 Wallach ..... A63B 43/002 473/594
2011/0079526 A1 * 4/2011 Blakeman ..... B65D 43/18 206/457
2013/0087524 A1 4/2013 Nuckles
2013/0299443 A1 11/2013 Stewart
2014/0076838 A1 * 3/2014 Siegi ..... B29C 49/06 215/44
2014/0158577 A1 * 6/2014 Furey ..... B65D 21/0231 206/520
2015/0266617 A1 * 9/2015 Furey ..... B65D 21/0228 206/520
2017/0320611 A1 11/2017 Shen
2018/0186562 A1 7/2018 Nisbet et al.
2018/0194537 A1 7/2018 Chan

* cited by examiner

INTERLOCKING INSULATED VESSEL

TECHNICAL FIELD

The subject matter described herein generally relates to an insulated vessel, and more specifically, to a vessel comprising a cylindrical container having an external screw thread and an insulated receiving component having a reciprocal screw thread for engaging with the cylindrical container.

BACKGROUND

Mechanisms for inserting a first object into a second object and hold that first object in place relative to that second object are known. For example, conventional locking mechanisms permit the securing of one object into another by connecting reciprocal components that protrude outward and inward from each object. However, these locking mechanisms, such as those that employ the L-slot configuration, can often be loosened easily, particularly when the objects are subjected to increasing levels of force. For example, two objects secured to each other via an L-slot configuration might separate from each other if the combined object is dropped or thrown. For example, if the first object that is inserted into a second object is not secured and is filled with content such as a liquid, the contents may spill if the two objects separate away.

BRIEF DESCRIPTION OF THE DRAWINGS

The disclosed embodiments have other advantages and features which will be more readily apparent from the following detailed description of the invention and the appended claims, when taken in conjunction with the accompanying drawings, in which:

DETAILED DESCRIPTION

The figures and the following description relate to preferred embodiments by way of illustration only. It should be noted that from the following discussion, alternative embodiments of the structures and methods disclosed herein will be readily recognized as viable alternatives that may be employed without departing from the principles of what is claimed.

Reference will now be made in detail to several embodiments, examples of which are illustrated in the accompanying figures. It is noted that wherever practicable similar or like reference numbers may be used in the figures and may indicate similar or like functionality. The figures depict embodiments of the disclosed system (or method) for purposes of illustration only. One skilled in the art will readily recognize from the following description that alternative embodiments of the structures and methods illustrated herein may be employed without departing from the principles described herein.

An interlocking vessel allows for simple and secure locking of a cylindrical container into an insulated receiving component via engagement of reciprocal screw threads on the exterior of the cylindrical container and the interior of the insulated receiving component. The external screw thread provides added grip to the cylindrical container such that it can be held without slipping through a person's fingers. The distance between the turns on the screw thread allows for even spacing between the holder's fingers and facilitates simple assembly of the interlocking vessel.

Figure 1:
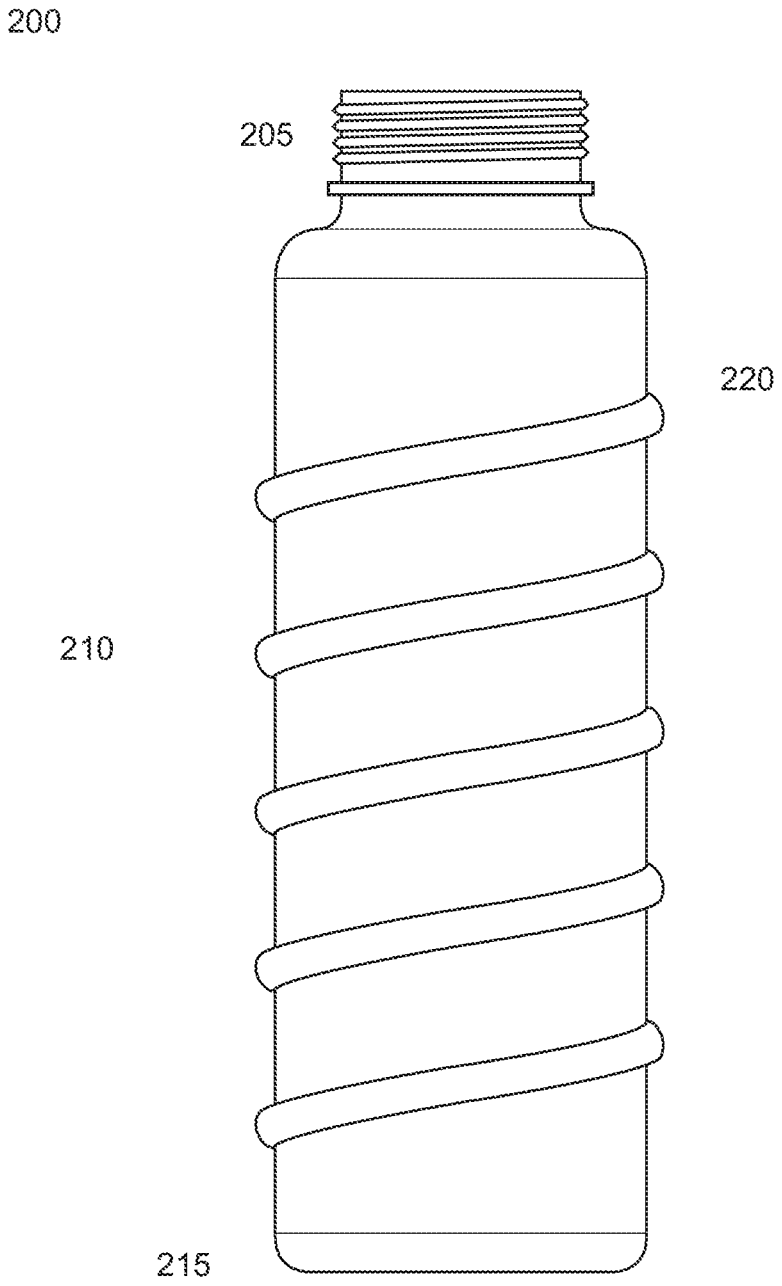
FIG. 1 illustrates an assembled interlocking vessel comprising a cylindrical container and an insulated receiving component, according to an example embodiment.

Referring now to FIG. 1, it illustrates an assembled interlocking vessel comprising a cylindrical container and an insulated receiving component, according to an example embodiment. The interlocking vessel 100 includes a cylindrical container 200 having a top 205 with a first external screw thread, a body 210 with a second external screw thread 220, and a bottom 215, and an insulated receiving component 300 having a top 305 and a bottom 310. Additional details about the cylindrical container 200 and the insulated receiving component 300 are included in the descriptions of FIGS. 2 and 3.

When the cylindrical container 200 is fully engaged with (e.g., inserted into) the receiving component 300 (i.e., the bottom 215 of the cylindrical container 200 is flush against the bottom of a hollow cavity inside the insulated receiving component 300), the top 205 of the cylindrical container 200 protrudes from the top 305 of the receiving component 300 and is structured to receive a cap for sealing the interlocking vessel 100.

Figure 2:
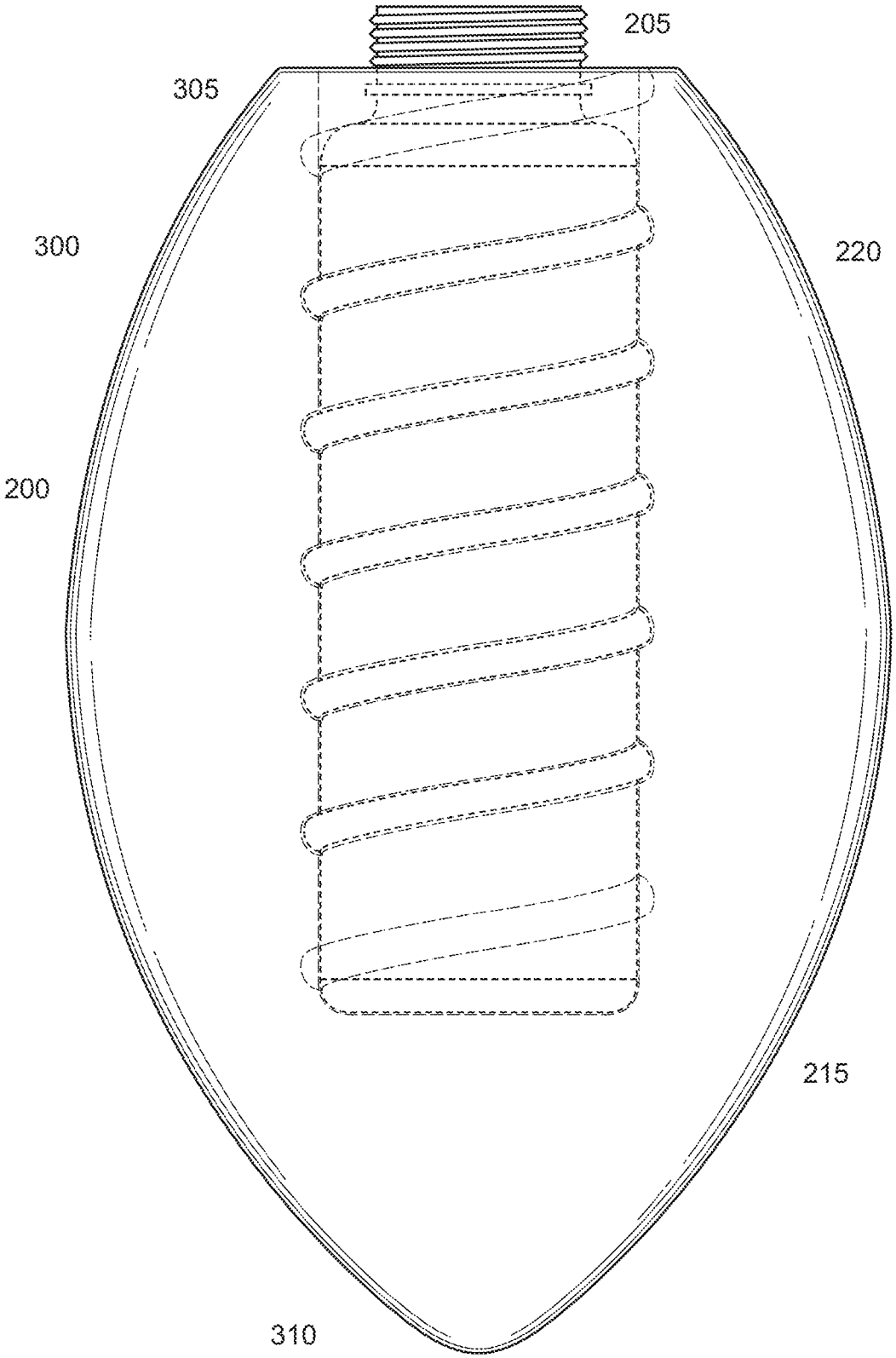
FIG. 2 illustrates a cylindrical container having a screw thread along the exterior body, according to an example embodiment.

FIG. 2 illustrates a cylindrical container 200 having a second screw thread 220 along the exterior body for engagement with a reciprocal screw thread on the insulated receiving component 300, according to an example embodiment. In one embodiment, the cylindrical container 200 is hollow and has an interior and exterior wall and is structured to receive content through an opening at the top 205.

The cylindrical container 200 may be made of metal, glass, and/or plastic. For example, in one embodiment, the cylindrical container 200 might be an aluminum bottle with a BPA-free plastic screw thread along the exterior body. In another example, both the cylindrical container 200 and the second screw thread 220 may be made of glass.

The cylindrical container 200 is approximately seven to ten centimeters in width, approximately eighteen to twenty-four centimeters in height, and may include a top 205, a body 210, and a bottom 215. The top 205 includes a first screw thread with a plurality of turns extending from a top portion of the top 205 downward towards a bottom portion of the top 205. In one embodiment, the first screw thread protrudes outward from the exterior wall of the cylindrical container 200 for engagement with a cap having a reciprocal inward screw thread. Alternatively, the first screw thread protrudes inward from the exterior wall of the cylindrical container 200 for engagement with a cap having a reciprocal outward screw thread.

The body 210 includes a second screw thread 220 with a plurality of turns extending from a top portion of the body 210 downward towards a bottom portion of the body 210. In one embodiment, the second screw thread 220 is larger than the first screw thread at the top 205 and protrudes outward from the exterior wall of the cylindrical container 200. The second screw thread 220 allows for engagement with a reciprocal inward screw thread 315 on the insulated receiving component 300. Alternatively, the second screw thread protrudes inward from the exterior wall of the cylindrical container 200 for engagement with a reciprocal outward screw thread 315 on the insulated receiving component 300. In either instance, the screw threads are in different elevational plane than the remaining outer portion of the exterior surface of the cylindrical container 200.

In one example embodiment, the second screw thread 220 is a unibody construction with the cylindrical container 200. Alternatively, the second screw thread 220 is constructed separate from, and overlaid on, the cylindrical container 200.

In one example embodiment, each turn of the second screw thread 220 protrudes outward from the exterior wall of the cylindrical container 200 by approximately one-half to one and one-half centimeters, is approximately one centimeter in thickness, and is approximately two to four centimeters from each adjacent turn of the second screw thread 220.

The bottom 215 has a flat surface and is enclosed for holding content, e.g., a liquid, received through the opening at the top 205. When the cylindrical container 200 is fully engaged with the insulated receiving component 300, the bottom 215 of the cylindrical container 200 rests flush against the bottom of a hollow cavity inside the insulated receiving component 300.

Figure 3:
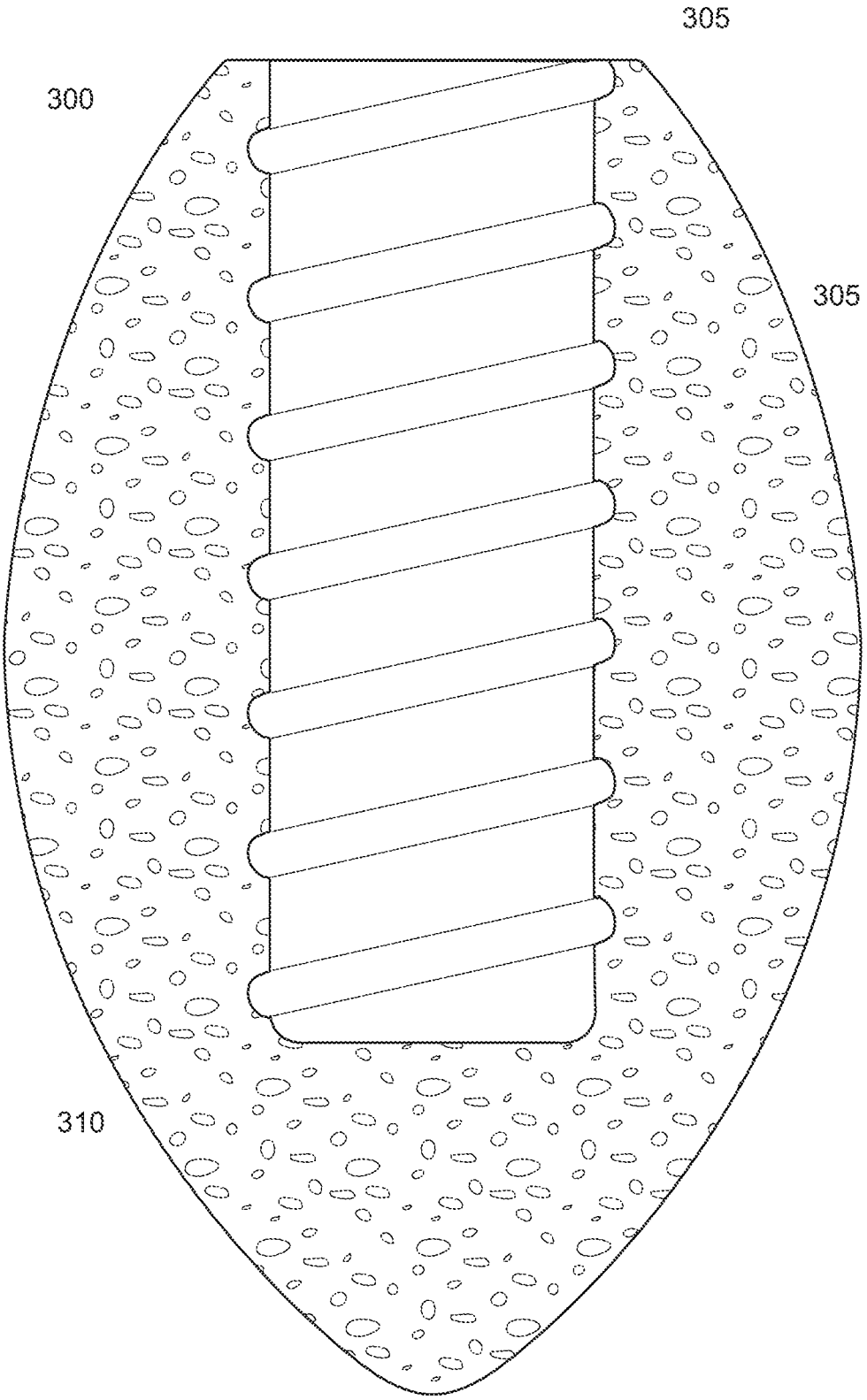
FIG. 3 illustrates an insulated receiving component having a reciprocal screw thread along the interior of the body, according to an example embodiment.

FIG. 3 illustrates an insulated receiving component 300 having a reciprocal screw thread along the interior of the body for engagement with the cylindrical container 200. The insulated receiving component 300 has a hollow cavity, the width of which matches the width of the cylindrical container 200. The height of the hollow cavity is approximately one to one and one-half centimeters less than the height of the cylindrical container 200 such that when the cylindrical container 200 is fully engaged with the insulated receiving component 300, the top 205 of the cylindrical container 200 protrudes from the top 305 of the insulated receiving component 300.

The insulated receiving component 300 may be made of foam, rubber, plastic, or any other suitable material that is capable of insulating the contents of the cylindrical container 200. Moreover, the insulated receiving component 300 may be made of a materials that also provides a protective surrounding about the cylindrical container 200.

In one example embodiment, the exterior of the insulated receiving component 300 has a raised surface to facilitate grip. For example, the exterior of the insulated receiving component 300 might include a series of raised circles that protrude approximately one-tenth of one centimeter from the exterior surface. In other embodiments, the surface of the exterior of the insulated receiving component is smooth.

The interior of the insulated receiving component includes a third screw thread 315 with a plurality of turns matching the number of reciprocal turns on the second screw thread 220 of the cylindrical container 200. Each turn of the third screw thread 315 has the same height and thickness of the turns on the second screw thread 220 and is the same distance apart from each adjacent turn. In embodiments where the second screw thread 220 is an outward screw thread, the third screw thread 315 protrudes inward such that when the cylindrical container 200 is fully engaged with the insulated receiving component 300, the cylindrical container 200 is secured in place. Conversely, in embodiments where the second screw thread 220 is an inward screw thread, the third screw thread 315 protrudes outward.

Figure 4:
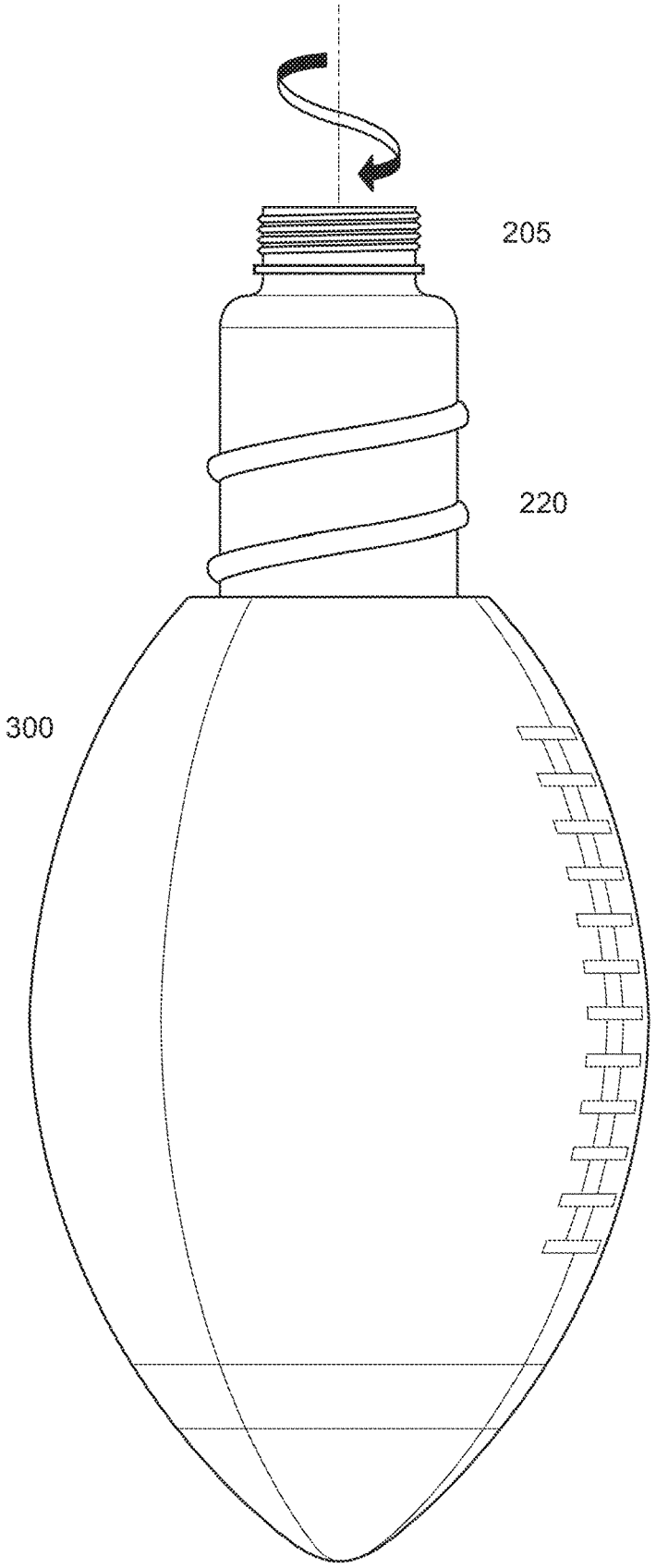
FIG. 4 illustrates a cylindrical container partially engaged with an insulated receiving component, according to an example embodiment.

FIG. 4 illustrates a cylindrical container 200 partially engaged with an insulated receiving component 300, according to an example embodiment. As discussed above with respect to FIG. 2, the cylindrical container 200 includes a second screw thread 220 with a plurality of turns that engages with a reciprocal third screw thread 315 in the insulated receiving component 300. In the example shown, the cylindrical container 200 has been partially engaged by turning the cylindrical container 200 in a downward clockwise motion into the insulated receiving component 300 such that the bottom 215 and a portion of the body 210 of the cylindrical container 200 are securely attached to the insulated receiving component 300 but not yet in their final resting positions inside the insulated receiving component 300. Responsive to a person holding the insulated receiving component 300 continuing to turn the cylindrical container 200 in a downward clockwise motion, the body 210 of the cylindrical container 200 will become fully engaged with the insulated receiving component 300 such that only the top 205 of the cylindrical container 200 protrudes from the insulated receiving component 300. Responsive to the person turning the cylindrical container 200 in an upward counterclockwise motion, the body 210 of the cylindrical container will disengage from the insulated receiving component 300.

Additional Configuration Considerations

The disclosed configurations provide a number of advantages over existing locking mechanisms. For example, the interlocking vessel allows for simple and secure locking of a cylindrical container into an insulated receiving component via engagement of reciprocal screw threads, thus preventing separation of the two objects when the vessel is subjected to increasing levels of force. Further, the external screw thread provides added grip to the cylindrical container such that it can be securely held, and the distance between the turns on the screw thread allows for even spacing between the holder's fingers and facilitates simple assembly of the interlocking vessel.

As used herein, the terms "comprises," "comprising," "includes," "including," "has," "having," or any other variations thereof, are intended to cover a non-exclusive inclusion. For example, a process, method, article, or apparatus that comprises a list of elements is not necessarily limited to only those elements but may include other elements not expressly listed or inherent to such process, method, article, or apparatus.

In addition, use of the "a" or "an" are employed to describe elements and components of the embodiments herein. This is done merely for convenience and to give a general sense of the invention. This description should be read to include one or at least one and the singular also includes the plural unless it is obvious that it is meant otherwise.

Upon reading this disclosure, those of skill in the art will appreciate still additional alternative structural and functional designs as disclosed from the principles herein. Thus, while particular embodiments and applications have been illustrated and described, it is to be understood that the disclosed embodiments are not limited to the precise construction and components disclosed herein. Various modifications, changes and variations, which will be apparent to those skilled in the art, may be made in the arrangement, operation and details of the method and apparatus disclosed herein without departing from the spirit and scope defined in the appended claims.

The invention claimed is:

1. A vessel comprising:

a cylindrical container with a top, a body, and a bottom, the top having an opening and the bottom enclosed, the container having a screw thread with a plurality of turns along an exterior wall of the body, in an elevational plane different than a remainder of the exterior wall of the body, and beginning at a first point at a top portion of the body and spiraling to the bottom of the cylindrical container; and a receiving component with a top and a bottom, the top having an opening and the bottom enclosed, the receiving component having a screw thread comprising a cavity with a plurality of turns forming a channel in an interior wall of the receiving component for engaging with the screw thread on the cylindrical container.

2. The vessel of claim 1, wherein the top of the container has an opening structured to receive content.

3. The vessel of claim 1, wherein the receiving component is insulated.

4. The vessel of claim 1, wherein the screw thread protrudes outward from the exterior wall of the body.

5. The vessel of claim 1, wherein the screw thread protrudes inward from the exterior wall of the body.

6. The vessel of claim 1, wherein each turn of the screw thread protrudes outward from the exterior wall of the body by approximately one-half to one and one-half centimeters.

7. The vessel of claim 1, wherein each turn of the screw thread is approximately one centimeter thick.

8. The vessel of claim 1, wherein each turn of the screw thread is approximately two to four centimeters from each adjacent turn.

9. The vessel of claim 1, wherein the screw thread is a unibody construction with the container.

10. The vessel of claim 1, wherein the screw thread is overlaid on the container.

11. The vessel of claim 1, wherein the container is made of metal.

12. The vessel of claim 1, wherein the container is made of glass.

13. The vessel of claim 1, wherein the container is made of plastic.

14. The vessel of claim 1, wherein the receiving component is made of foam.

15. The vessel of claim 1, wherein the receiving component is made of plastic.

16. A vessel comprising:

a cylindrical bottle with a top, a body, and a bottom, the top having an opening and the bottom enclosed, the bottle having a first screw thread with a plurality of turns at the top and a second screw thread with a plurality of turns beginning at a first point at a top portion of the body and spiraling to the bottom of the cylindrical container; and an insulated receiving component with a top and a bottom, the top having an opening and the bottom enclosed, the receiving component having a screw thread comprising a cavity with a plurality of turns forming a channel in an interior wall of the receiving component for engaging with the second screw thread on the cylindrical bottle.

17. The vessel of claim 14, wherein the second screw thread protrudes outward from the exterior wall of the body.

18. The vessel of claim 14, wherein the second screw thread protrudes inward from the exterior wall of the body.

19. The vessel of claim 14, wherein the second screw thread has five turns.

20. The vessel of claim 14, wherein the second screw thread has seven turns.

* * * * *